United States Patent [19]

Gazzarrini

[11] Patent Number: 4,620,650

[45] Date of Patent: Nov. 4, 1986

[54] METHOD AND APPARATUS FOR AUTOMATICALLY POSITIONING TUBULAR PANTYHOSE LEGS

[75] Inventor: Vinicio Gazzarrini, Florence, Italy

[73] Assignee: Solis S.r.l., Italy

[21] Appl. No.: 786,943

[22] Filed: Oct. 11, 1985

[30] Foreign Application Priority Data

Jul. 25, 1985 [EP] European Pat. Off. ..... 85830193.0

[51] Int. Cl.[4] ..... A41H 43/00

[52] U.S. Cl. ..... 223/43; 223/112

[58] Field of Search ..... 223/43, 75, 76, 77, 223/112, 60, 66; 112/121.15

[56] References Cited

U.S. PATENT DOCUMENTS

| | | | |
|---|---|---|---|
| 2,166,053 | 7/1939 | Heliot | 223/112 |
| 4,421,259 | 12/1983 | Sewell et al. | 223/112 X |
| 4,487,546 | 12/1984 | Cassinelli | 223/41 X |
| 4,550,868 | 11/1985 | Hodges et al. | 223/43 |

FOREIGN PATENT DOCUMENTS

| | | | |
|---|---|---|---|
| 1441188 | 6/1976 | United Kingdom | 112/121.15 |
| 1577758 | 10/1980 | United Kingdom . | |

*Primary Examiner*—Louis K. Rimrodt

*Attorney, Agent, or Firm*—McGlew and Tuttle

[57] ABSTRACT

A carriage is reciprocately movable along the length of a pair of eversion tubes which carry pantyhose legs in an everted condition. The carriage carries two pairs of grippers which are engageable over each pantyhose leg and on side fingers on each tube. The grippers are brought to a partially closed position where they do not touch the fabric while the carriage is slowly moved along the tubes to scan the exterior of the fabric. A detection point is provided on the fabric which is detectable by a probe that operates a mechanism for fully closing the grippers. Further movement of the carriage with the grippers closed causes sliding of the fabric on the tubes. Even with the detection points misaligned on the tubes, the grippers will close at the appropriate instant to concurrently bring both legs of the pantyhose to the ends of the tubes.

14 Claims, 13 Drawing Figures

FIG. 4
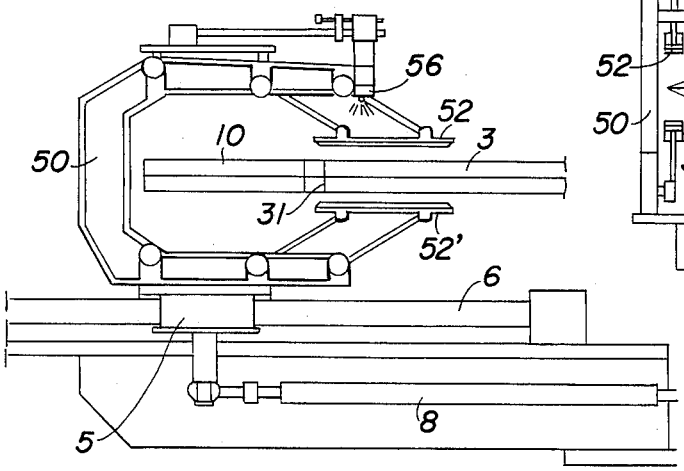
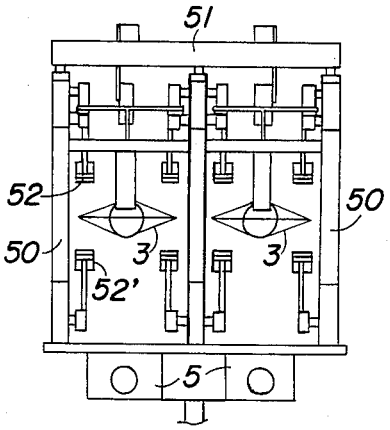
FIG. 5
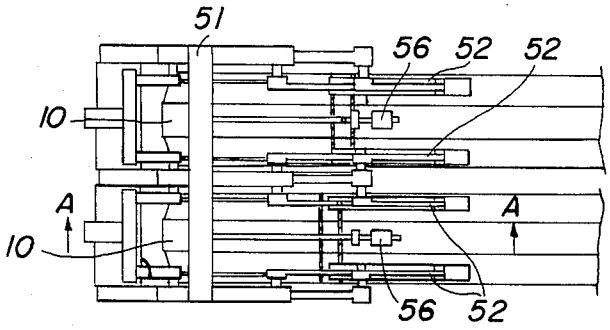
FIG. 3
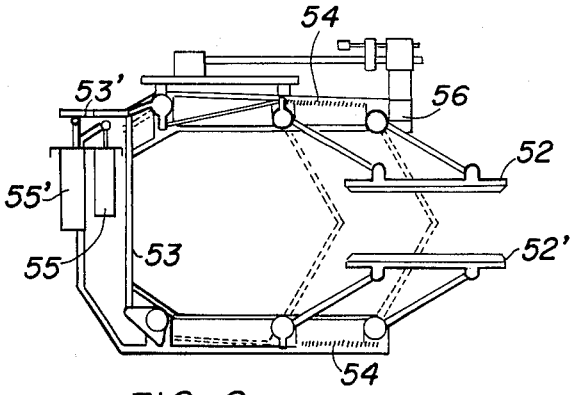
FIG. 6

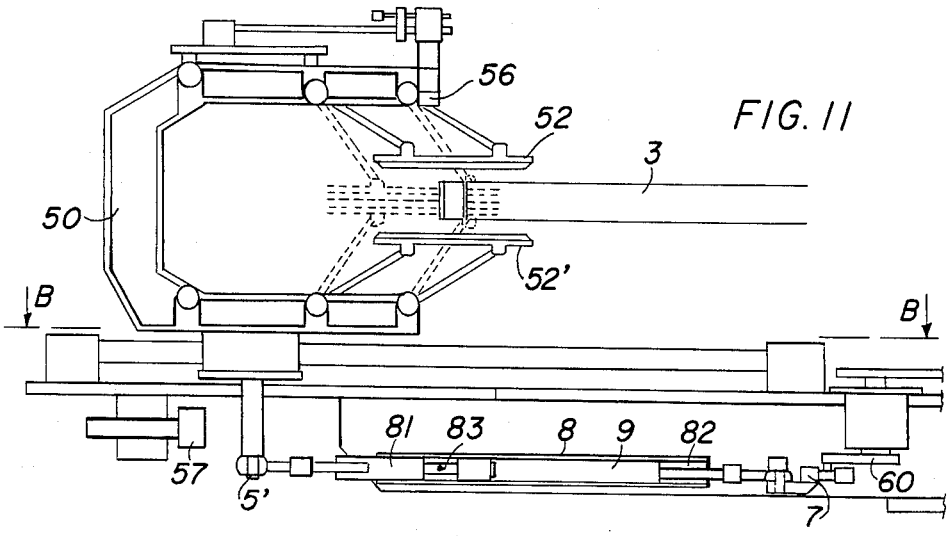
FIG. 11
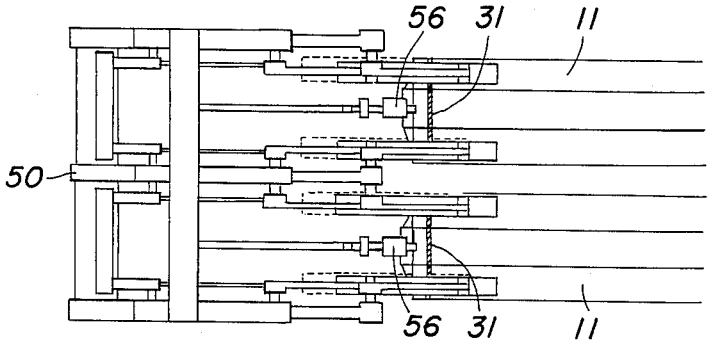
FIG. 10
FIG. 12
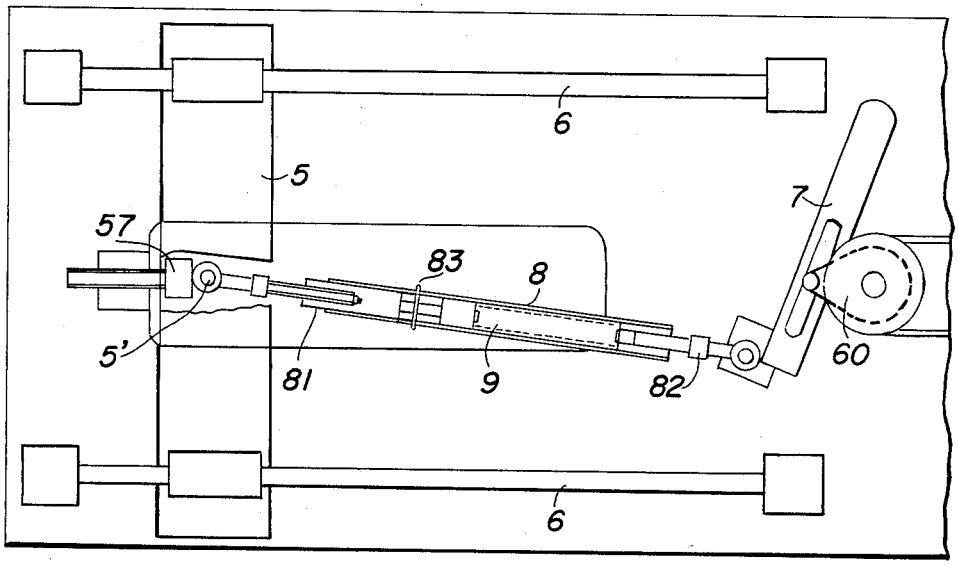

METHOD AND APPARATUS FOR AUTOMATICALLY POSITIONING TUBULAR PANTYHOSE LEGS

FIELD AND BACKGROUND OF THE INVENTION

The present invention relates in general to the field of pantyhose manufacture, and in particular to a new and useful method and apparatus for automatically positioning the two tubular legs (or hose blanks) of a pantyhose over the tubes of a suction everter in a toe-closure machine in order to perform a correct and accurate sewing of the toes.

Known toe-closure machines include suction everter tubes which provide a support for turning the tubular legs or hose blanks inside out. Two side fingers are longitudinally slidable relative to the everter tubes and provide for the transfer of the hose toe to be sewn in a sewing machine associated with the toe-closure machine.

U.K. Pat. No. 1,577,758 discloses an automatic device for placing the end toe of a hose blank to be sewn, at a predetermined position on the tube of the suction everter. The suction everter includes a fixed position-sensor (e.g. a photoelectric cell) capable of detecting a detail (e.g. the free end) of the hose, and further includes hose gripping means which cooperate with the side fingers of the everter to first shift the hose forwared, that is toward the free end of the tube in order to make the detail move past the sensor, and then backward until the hose detail reaches a position corresponding to the sensor thereby causing the sensor to initiate the opening of the gripping means.

This known device includes gripping means which always clamp the hose at the same position relative to the tube and push the hose along a path of constant length. Moreover, since the freed end of the hose, once its eversion on the tube has been completed, is at a position which may vary within broad limits, the gripping means always clamp the hose at some distance from its end. Accordingly, during the forward motion of the hose, that is in the direction of the free end of the tube, several creases (or puckers) are bound to occur in the hose end zone which is not engaged by the gripping means. This happens even if the hose is moved at a low speed. To remove these creases it is necessary to draw the hose back at low speed.

SUMMARY OF THE INVENTION

The main object of the present invention is to overcome the afore-mentioned disadvantages. The invention provides the transfer of the two legs of a pantyhose onto the two tubes and fingers of a suction everter, from any eventual initial position of each leg up to a final predetermined position of both legs, by means of a single and fast approach stroke.

According to the invention a carriage is provided which is movable in a direction parallel to the everter axis end which carries two probes (sensors) which detect the position of the leg toes upon completion of their eversion. The invention also includes two pairs of grippers for transfer of the leg toes to be sewn along the side fingers of the everter tubes from the position of eversion completion to that position which is predetermined for the sewing operation. When, during the travel of the carriage toward the free end of the tubes, each probe detects a predetermined point of the corresponding hose (or leg), the probe causes the relevant pair of grippers to clamp down on the hose. This caused transfer of the hose up to the carriage stroke limit corresponding to the predetermined sewing position. Once reaching the stroke limit position, the carriage stops while each pair of grippers remains closed on the relevant hose. Subsequently, as soon as a central unit for the machine control (e.g. a rotating cam controller for setting the various operative phases of the machine), has completed a cycle or a revolution, it operates the opening of the grippers to release the legs at the predetermined sewing position and to permit the tubes to advance one step thereby starting a new cycle.

The advantages of the present invention consist essentially in that it is possible to perform the previous eversion, that is the turning inside-out of the legs onto the everter tubes, much faster than has so far been obtained. The legs are also made to slide up to the predetermined sewing position by drawing them during a single transfer motion. The grip of each leg is always operated in correspondence with its free end whatever the starting position of each leg may be. The transfer of the legs is carried out at a very high speed and with the fabric in a stretched condition. It is further possible to change the leg release position. The release of the legs is operated when the carriage is at a standstill to avoid any error due to inertia.

The invention is disclosed in detail by the following description in conjunction with the accompanying drawings which show one embodiment of the invention.

BRIEF DESCRIPTION OF THE DRAWINGS

In the drawings:

FIG. 3 is a plan view of a device according to the invention with the two tubes of the everter of FIG. 2 in the condition corresponding to the end of their idle stroke;

FIG. 4 is a front view of the device of FIG. 3;

FIG. 5 is a left side view of the device of FIG. 3;

FIG. 6 is a sectional view taken on line A—A of FIG. 3;

FIG. 10 is a plan view of the device of FIG. 3, in a condition corresponding to the end of transfer for the two legs;

FIG. 11 is a front view of the device of FIG. 10;

FIG. 12 is a sectional view taken on line B—B of FIG. 11; and

DESCRIPTION OF THE PREFERRED EMBODIMENTS

According to the present invention, the method for automatically positioning the tubular legs (or hose blanks) of a pantyhose onto the tubes of a suction everter in a toe-closing machine for pantyhose includes the mechanical withdrawal of the hoses from the inside of the tubes, the turning inside out of the hoses onto the tubes and the compulsory sliding of the hoses onto the side fingers of the tubes. The inventive method comprises the followng sequence of steps:

(a) Positioning a carriage to move the legs, the carriage being movable with reciprocating motion in direction parallel to the everter tubes and carrying two photoelectric probes for detecting a detectable point of the pantyhose legs that are turned inside out on the tubes, the carriage also carrying two pairs of grippers which are closeable on the relevant side fingers of the tubes in order to draw the legs to the predetermined sewing position at such a preset location relative to the tubes that the grippers are above the legs and retracted with respect to the toes to be sewn, upon completion of the hose eversion on the tubes;

(b) Exploring the hoses along a generatrix and detecting, by means of the two photoelectronic probes or sensors, the position of a present detectable point of each hose while at a standstill on the corresponding tube;

(c) Clamping down on each hose in cooperation with the fingers of the relevant tube and through the control of the relevant photoelectronic probe as soon as the probe has detected the preset detectable point of the hose;

(d) Moving the two pairs of grippers thus closed and the hose toes to be sewn along the fingers of the tubes toward the free ends of the tubes and up to the end of the carriage return stroke:

(e) Stopping the carriage at the end of its return stroke while keeping the grippers closed; and (f) Opening the grippers just before the beginning of a new cycle.

Figure 1:
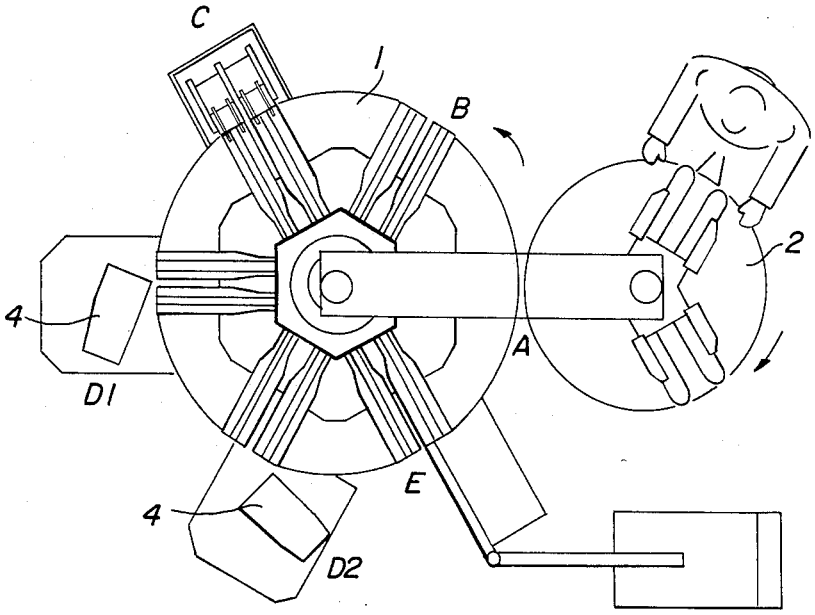
FIG. 1 is a schematic top plan view of a toe-closing machine for women's pantyhose including a carrousel structure with a number of arms, rotating step by step, and being provided with a device for positioning the legs (hoses) onto suction everter tubes according to the present invention.
Figure 2:
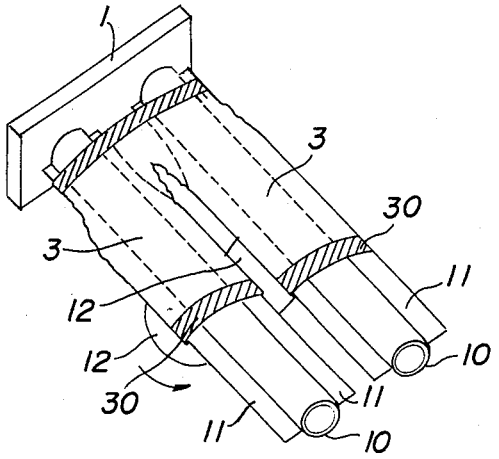
FIG. 2 is a perspective view showing in detail the two tubes and fingers of an everter in the machine of FIG. 1, where the two leges are in their everted position after completion of the eversion operation.

The travel for initial positioning of the carriage is performed toward the center of a carrousel 1 shown in FIG. 1, during a one-step advancement of the carrousel. The grippers are opening during this positioning and the probes are deactivated. The travel for exploring the hoses and transferring them toward the free end of the tubes takes place during a dwell time for the carrousel with the grippers being partially closed on the beginning of this travel without actually touching the hose fabric.

The detectable point of the hose may be the boundary between the two welt (reinforcement) and the remainder of the hose or the hose end, or also a mark, like a dark color thread preinserted in the hose fabric.

The apparatus for carrying out the inventive method is shown in FIGS. 1 through 6 and comprises, in combination, a pair of horizontal, side by side, everting tubes 10, 10 integral with an arm of the carrousel type structure 1 having a plurality of arms which rotate step by step in counterclockwise direction (FIG. 1) about its central vertical axis. The carrousel 1 forms part of a toe-closing machine for pantyhose with a number of stations (A-B-C-D1-D2-E) in which the station A is provided for an automatic feeding of pantyhose in an inside-out condition which is accomplished by a device 2 not included in the present invention. The station B is for withdrawing the pantyhose leg from the inside of the two tubes 10 and completing their eversion on the exterior of the tubes by means of two rollers 12 (FIG. 2) that are known per se. Station C is for positioning the two hoses 3 in a predetermined position on the tubes 10 by means of the apparatus according to the present invention. Stations D1 and D2 are for sewing the toes 30 of the right and left legs 3 of the pantyhose respectively. The toes are sewn by means of two cutting and sewing machines 4 which are also known per se. The cutting and sewing machines 4 simultaneously operate for sewing the right leg and the left leg of two different pantyhoses at stations D1 and D2. The station E is for turning the finished pantyhose right side-out and moving it away in right side-out condition by suction means known per se.

The invention comprises a mobile carriage 5 which is shown in FIGS. 4 and 6 and which is movable in timed relationship with the movements of the carrousel structure 1. Carriage 5 runs on a horizontal rail 6 located beneath the two tubes 10 which are at rest in the station C. The carriage 5 also carries on its top, three brackets 50 each with a C-shaped vertical profile (FIG. 4) which are parallel and juxtaposed to the tubes 10 and connected between them by crosspiece 51 in such a way as to let tubes 10 transit freely during the stepwise rotation of carrousel 1.

Two pairs of horizontal jaws 52, 52' are pivotally connected between adjacent brackets 50. The upper jaws 52 are pivotally engaged to the upper arms of the brackets and the lower jaws 52' are engaged to the lower arms, respectively. A linkage 53 is connected between jaw pairs 52, 52' in order to make up two corresponding grippers (52,52') which close, longitudinally and from opposite sides, on the lateral fingers 11 of tube 10 partially by the action of two return springs 54. The grippers open through the action of a suction cylinder 55' mounted on the web of bracket 50. The closing of grippers 52, 52' takes place in two phases since a bracket 53' of the linkage 53 is actuated both by the rod of the suction control cylinders 55' (which is actuated by the control central unit), and by the rod of another suction control cylinder 55, which is actuated by one of the probes and which is shorter than the rod of cylinder 55'. Thereby, upon the lowering of the rod of cylinder 55' and until the rod of cylinder 55 is raised, the grippers 52,52' close only partially.

Two photoelectronic probes 56 are mounted on the upper crosspiece and are lined up in the transverse direction above the tubes 10, each of these probes being in retracted position relative to the two ends of jaws 52 of the corresponding tube 10. The position of each probe 56 in the direction parallel to the axis of the corresponding tube 10, is adjustable at will in relation to the preset detectable point 31 of the hose 3 and to the predetermined position for the sewing of the hose.

Each of the probes 56 is connected to a corresponding cylinder 55 in such a way as to cause, separately, the complete closure of the corresponding grippers 52, 52' on the fingers 11 of the two tubes 10 when, after each leg has been individually explored because of the movement of carriage 5, the preset detectable point 31 of each leg has been sensed. As noted above, the detectable point may be a thread or, as in the present case, the edge of a toe welt 30, or any other type of mark or indicia.

The reciprocating rectilinear movement of the carriage 5 is derived from a central motor reduction unit of the machine through the interposition of an oscillating link 7 in FIGS. 11 and 12 and a connecting rod 8 so that, at each operating cycle of the two-closing machine, the carriage 5 performs a faster idle forward stroke and a less fast operative return stroke. The end of the return stroke, that is, the operative stroke, of the carriage 5 is determined by a stop 57 whose position is adjustable in the stroke direction of carriage 5. The connecting rod 8 is made up of a tubular rod whose head 82 is articulated to the link 7 and whose foot 81, which is articulated to the carriage 5 by means of a pivot 5', is slidably engaged in the rod 8 and connected thereto through a pin 83 engaged in a guide slot whose length determines the maximum travel of the foot 81. Link 7 is reciprocated by a central motor reduction unit 60.

A counteracting spring 9, interposed between the head 82 and the foot 81 of the connecting rod 8, cooperates with the telescopic movement of foot 81 in rod 8. When the carriage 5 has ended its return stroke (to the left in FIG. 11) and is at rest against stop 57, and until the link 7 has reached its corresponding dead point, the foot 81 withdraws from rod 8, whereas, after the link 7 has passed the dead point (center) and the spring 9 is stretched, the foot 81 projects up to the point of pulling the carriage 5 and thus starting the successive forward stroke of the carriage (to the right in FIG. 11).

Figure 13:
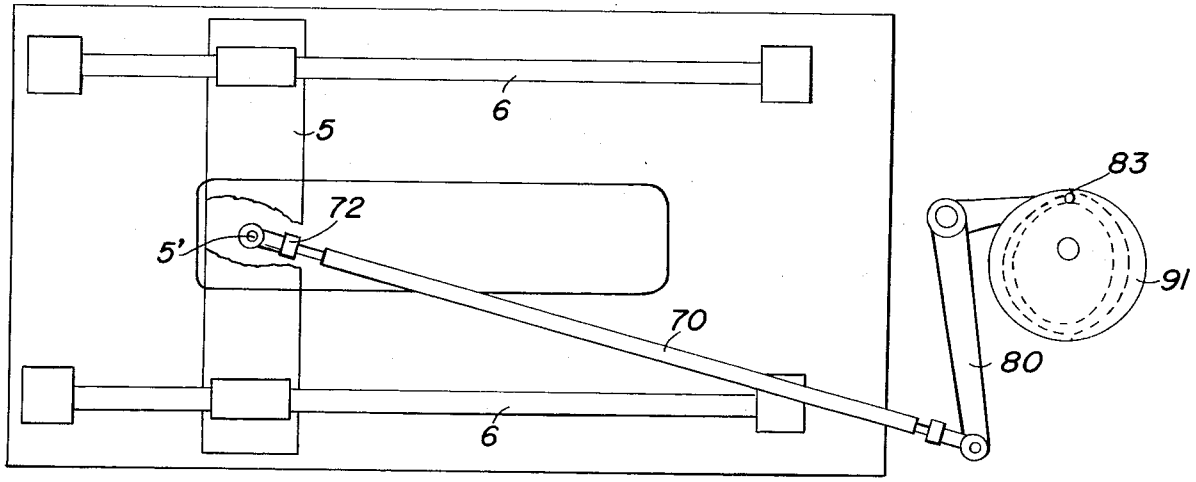
FIG. 13 is a detail of a modification of the mechanism (linkage) of FIG. 12.

As an alternative to the oscillating link mechanism (7,8) and with reference to FIG. 13 of the accompanying drawings, there may be used a leverage (70, 80) with the end 72 articulated to the carriage 5 and with the end 83 rolling on a cam 91 mounted on the shaft of the central motor reduction unit and whose profile is such as to permit a dwell of carriage 5 at the end of its backward stroke.

Finally, each of the cylinders 55 is interlocked with a single switch which is, in turn, actuated by a central control unit, for example, a cam controller (not shown for sake of clarity in the accompanying drawings) rotating in such a way as to simultaneously open the two pairs of grippers 52,52' and thus release the two legs (hoses) at the predetermined sewing position on the two tubes 10 just before the beginning of a new cycle.

According to the invention, there are further provided the two probes 56 for each tube of the suction everter, located above the tube in the vicinity of the side fingers. One probe is associated with one gripper 52,52' and the other with the other gripper. The probes are connected to the two corresponding cylinders 55 for separately actuating the grippers 52,52' in order to permit a gripping of the hose on the fingers 11 of tube 10 at different times and have the free end of the hose disposed at right angle to the axis of tube 10 upon the end of its transfer, that is, at the predetermined sewing position. Should the hose be obliquely oriented to the axis of tube 10 after completeion of its eversion on the tube, the grippers actuated separately by the probes, will correct this.

The operation of the invention is as follows: While the carrousel moves one step forward, the carriage 5 performs the forward idle stroke, that is, with the grippers wide open, towards the center of the carrousel 1 and when the two tubes 10 with the two legs 3 in inside-out condition thereon, arrive and stop at station C, the carriage 5 has already reached the end of its forward stroke and is at rest. Immediately after this the carriage 5 with the grippers 52, 52' partially closed but not in touch with the fabric (as indicated by short dashes line in FIG. 8), performs the backward or return stroke during which, each of the probes 56 lengthwise explores the relevant hose 3 and as soon as each of the probes has detected its present detection point 31, it operates the relevant cylinder 55 thereby causing the complete closure of corresponding grippers 52,52'. After this, the toe welt end 30 of each hose 3 is drawn up to the backward stroke limit of carriage 5 at which the carriage stops and the grippers 52,52' remain closed. Subsequently, the central control unit of the machine gives its consent, just before the beginning of the next operative cycle, by means of a switch for the cylinders 55,55' to operate, thereby causing the instantaneous opening of all the grippers 52,52' and hence, the release of the toes of the two hoses 3 in the predetermined sewing position.

Figure 8:
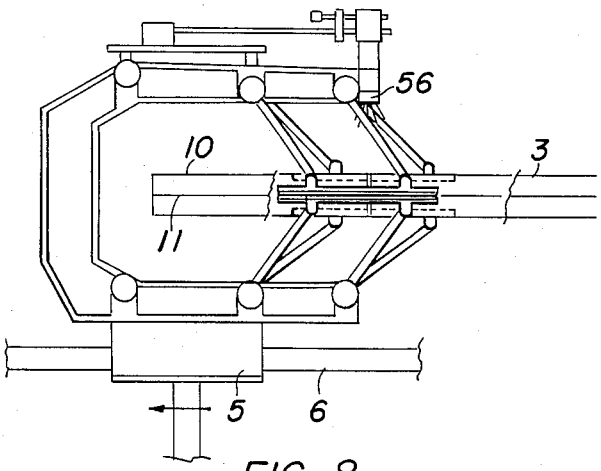
FIG. 8 is a front view of the device of FIG. 7.
Figure 9:
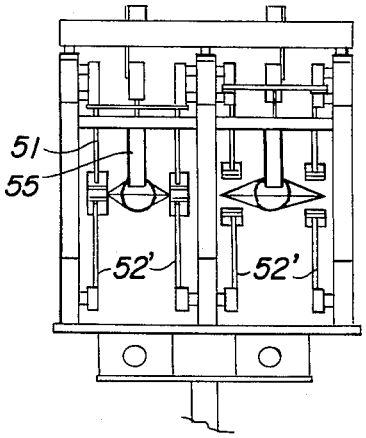
FIG. 9 is a left side view of the apparatus of FIG. 7.
Figure 7:
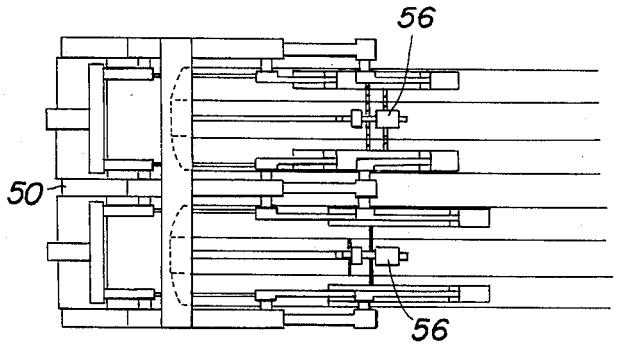
FIG. 7 is a plan view of the device of FIG. 3 shown in the condition of a leg (hose) transfer start.

FIGS. 7 through 9 show the situation wherein one pair of grippers has closed in response to its probe having reached detectable point 31, while the other pair of grippers remains open since the hose on its corresponding tube is positioned slightly differently than the hose on the other tube so that the probe has not yet reached the detectable point to close its grippers. By having the grippers operate independently the ends of both hoses can be brought to the same position at the end of their tubes.

While specific embodiments of the invention have been shown and described in detail to illustrate the application of the principles of the invention, it will be understood that the invention may be embodied otherwise without departing from such principles.

What is claimed is:

1. A method of automatically positioning tubular legs of a pantyhose which are on two suction everter tubes in an everted condition, the tubes each having side fingers and the legs each having a detection point and toe ends, comprising the steps of:

(a) positioning a carriage in a predetermined position relative to the tubes, over the legs and spaced from the toe ends thereof, the carriage having two pairs of grippers which are closable to engage the legs and to cooperate with the side fingers to move the legs with movement of the carriage, the carriage being reciprocately movable in a direction parallel to the tubes, the carriage being at the predetermined position with its grippers open;

(b) partially closing the grippers to move them close to the legs without touching the legs, the carriage having a sensor probe for each pair of grippers for sensing the detection point of each leg;

(c) moving the carriage with the grippers partially closed along the legs for causing the sensor probes to detect an initial position for the detection point of each leg;

(d) fully closing each of the pair of grippers separately when its sensor probe has detected the initial position of the detection point on its respective leg, in order to engage the respective leg and commence its movement along its tube with movement of the carriage;

(e) continuing to move the carriage with the grippers closed for moving the legs from their initial position to a final sewing position, the toe ends of the legs being moved toward ends of the tubes, said final positions corresponding to a stroke end position for the carriage;

(f) holding the carriage stationary and its stroke end position while maintaining the grippers closed on the legs; and (g) opening the pairs of grippers before moving the tubes with the legs at their final position away from the carriage.

2. A method according to claim 1, including moving the carriage along the length of the legs on the tubes to position the carriage at its predetermined position before partly closing the grippers so that the sensor probes scan substantially the full length of the legs.

3. A method according to claim 1, wherein the two pairs of grippers are actuated separately by their respective sensor probes for closing at a different time when the detection points of the legs are not aligned in a direction parallel to the tubes, for bringing the toe ends of the legs in the same final position.

4. A method according to claim 1, including actuating each gripper of a pair for engaging the side fingers of one tube, and different times for bringing the leg into its final position with its toe end extending perpendicular to the direction parallel to the tubes.

5. An apparatus for automatically positioning tubular legs of a pantyhose which are on two suction everter tubes in an everted condition, the tubes each having side fingers and the legs each having a detection point and a toe end, comprising:

at least one rail extending parallel to the tubes;

a carriage slidably mounted to said rail along the tubes;

carriage movement means connected to said carriage for moving the carriage in a reciprocating stroke on said rail;

at least two sensor probes connected to the carriage and facing the tubes for a lengthwise examination of legs on the tubes for detecting the detection point of each leg;

two pairs of grippers movably mounted to said carriage, each pair of grippers being positioned for cooperating with the side fingers of each tube;

first gripper drive means connected to each of said pair of grippers for moving said grippers into a partially closed position for movement toward the tubes but spaced from the tubes; and second gripper drive means connected to each of said two pairs of grippers for fully closing each pair of grippers to engage a leg on each tube and to cooperate with the side fingers of each tube for moving the legs with movement of said carriage said second gripper drive means being connected to each of said probes for closing a pair of grippers associated with each probe when said probe detects the detection point.

6. An apparatus according to claim 5, wherein said sensor probes each comprise a photoelectronic probe, said first gripper drive means comprising a first suction control cylinder connected to each of said two pairs of grippers and a return spring connected to each of said two pairs of grippers for urging each of said two pairs of grippers into open position away from the tubes, said second gripper drive means comprising a second suction control cylinder connected to each of said pairs of grippers.

7. An apparatus according to claim 6, wherein each photodetector probe is connected to said carriage at a position perpendicularly above an axis of each tube respectively in a zone intermediate the grippers in each pair of grippers.

8. An apparatus according to claim 6, wherein each probe has an adjustable position on said carriage with respect to a direction parallel to the tubes.

9. An apparatus according to claim 8, wherein each photodector probe is connected to said carriage at a position perpendicularly above an axis of each tube respectively in a zone intermediate the grippers in each pair of grippers.

10. An apparatus according to claim 6, wherein said carriage comprises three C-shaped brackets spaced in a direction transverse to an axis of the tubes, each tube being positioned between adjacent C-shaped brackets, and the tubes being movable in a direction transverse to their axis between legs of the C-shaped brackets, each gripper in said two pairs of grippers comprising an upper jaw pivotally mounted to an upper leg of each bracket and a lower jaw pivotally mounted to a lower leg of each bracket.

11. An apparatus according to claim 10, including a linkage connected between the upper and lower jaws of each gripper, said first and second suction control cylinders being connected for moving said linkage against the action of said spring.

12. An apparatus according to claim 5, including a stop for determining one end of the stroke for said carriage with engagement of said carriage against said stop, a carrousel which is rotatable about a central axis for carrying the tubes and for moving the tubes passed said carriage with said carriage near said stop to move tubes from a position adjacent said carriage to a sewing position spaced from said carriage.

13. An apparatus according to claim 12, wherein said carriage movement means comprises a first linkage pivotally mounted at a fixed location with respect to the tubes, a drive motor for pivoting the first linkage, and a second linkage connected between said first linkage and said carriage for moving said carriage with pivoting of said first linkage.

14. An apparatus according to claim 12, wherein said carriage movement means comprises a cam rotatably mounted in a position which is fixed with respect to the tubes, a first lever pivotally mounted adjacent said cam and engaged with said cam for pivoting with rotation of said cam, and a second lever connected between said first lever and said carriage for moving said carriage with rotation of said cam.

* * * * *